United States Patent [19]

Sanner

[11] 4,287,845

[45] Sep. 8, 1981

[54] SAILBOAT HAVING MULTIPLE HULLS

[76] Inventor: Sidney N. Sanner, P.O. Box 1173, Tryon, N.C. 28782

[21] Appl. No.: 69,239

[22] Filed: Aug. 23, 1979

[51] Int. Cl.[3] ..... B63B 35/00; B63H 9/00

[52] U.S. Cl. ..... 114/39; 114/61; 114/90; 114/124; 114/150; 114/123

[58] Field of Search ..... 114/56, 43, 39, 61, 114/121, 123, 124, 150, 274, 281, 90, 283, 288, 290, 292; 9/1.1, 1.7

[56] References Cited

U.S. PATENT DOCUMENTS

| | | | |
|---|---|---|---|
| 1,678,023 | 7/1928 | Stites | 114/123 |
| 2,238,464 | 4/1941 | Fletcher | 114/39 |
| 2,608,060 | 8/1952 | Smith | 114/150 |
| 3,212,109 | 10/1965 | Roman | 114/39 |
| 3,417,720 | 12/1968 | Covell | 114/39 |
| 3,922,994 | 12/1975 | DeLong | 114/123 |

*Primary Examiner*—Trygve M. Blix
*Assistant Examiner*—D. W. Keen
*Attorney, Agent, or Firm*—Bell, Seltzer, Park & Gibson

[57] ABSTRACT

A sailing craft is provided which has the ability to limit heeling under various headings, and which includes a deck assembly mounted for lateral movement between two outrigger type hulls. The deck assembly may be moved toward the windward side of the craft, and so that its weight and that of the crew serve to counteract heeling resulting from the wind forces. A third hull is mounted adjacent the bow portion of the deck assembly, and the three hulls are disposed in a triangular, highly stable arrangement. Also, apparatus is provided whereby the crew may selectively rotate the third hull about a vertical axis to effect steering of the craft.

8 Claims, 4 Drawing Figures

SAILBOAT HAVING MULTIPLE HULLS

The present invention relates to a multi-hull sailing craft characterized by the ability to limit heeling under various headings to thereby maximize the effective sail area and speed.

As is well recognized, sailboats tend to heel in the leeward direction from the wind forces, when either beating against the wind or on a reach. In a strong wind, such heeling significantly reduces the effective sail area and thus speed, and it also results in the hull contacting the water at an angle which increases its resistance to forward movement through the water, to further limit speed. In addition, severe heeling can result in the capsizing of the boat, or taking water over the leeward side.

Proa-like sailboats have been proposed which are intended to limit heeling, and which comprise a relatively large central hull and a pair of smaller stabilizing outrigger hulls mounted at the sides of the central hull. In one such prior sailboat, the outrigger hulls are mounted to the central hull by means of a slide bar, whereby the outrigger hulls may be moved laterally across the central hull, note for example, the U.S. patent to Stites, U.S. Pat. No. 1,678,023.

It is an object of the present invention to provide an improved multi-hull sailing craft which has substantial stability, and provision for more effectively limiting heeling to thereby maximize the effective sail area and speed.

It is also an object of the present invention to provide a sailing craft of the described type having a novel ground support or hull arrangement which is applicable to various types of sailing craft, including ice boats and wheeled sailing craft.

It is a more specific object of the present invention to provide a sailing craft having three triangularly arranged supporting members or hulls, and having provision for readily steering the craft by pivoting one or more of the supporting members or hulls about a vertical axis.

These and other objects and advantages of the present invention are achieved in the embodiment illustrated herein by the provision of a sailing craft comprising first and second supporting members or hulls interconnected in a laterally spaced apart relationship, a deck assembly having a mast and a third supporting member or hull mounted thereto, means mounting the deck assembly to the first and second supporting members or hulls to permit relative lateral movement therebetween, and so that the three supporting members or hulls are disposed in a triangular arrangement and are adapted to concurrently support the weight of the craft. Means are also provided for selectively moving the deck assembly laterally between the first and second supporting members or hulls, so that the weight of the deck assembly and crew may be moved toward the windward side to minimize heeling of the craft. Preferably, the third supporting member or hull is mounted to the deck assembly for rotation about a vertical axis, and steering means may then be provided for rotating the third supporting member or hull about its vertical axis to effect steering of the craft.

Some of the objects having been stated, other objects will appear as the description proceeds, when taken in connection with the accompanying drawings, which are somewhat schematic in form, and in which—

Figure 1:
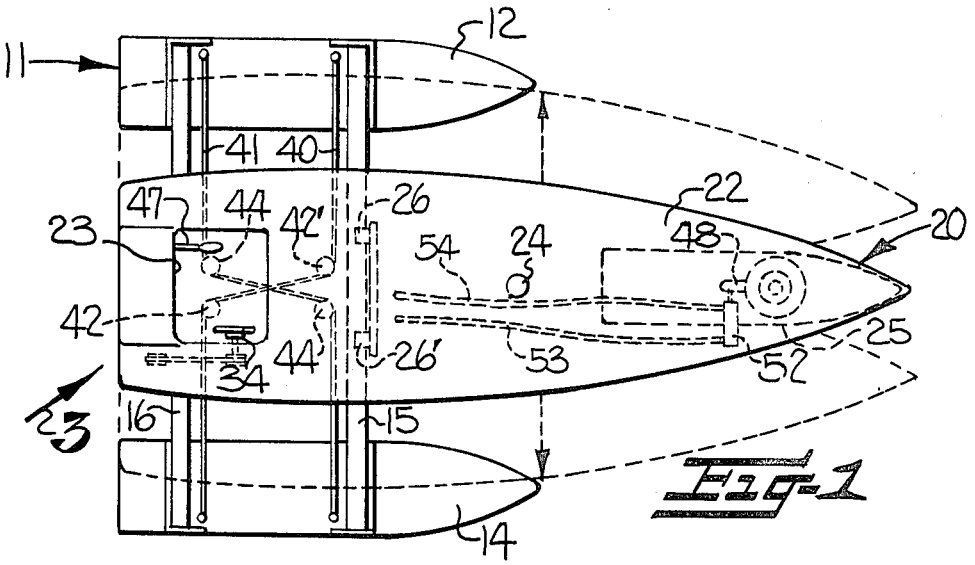
FIG. 1 is a top plan view of a sailboat embodying the features of the present invention.
Figure 2:
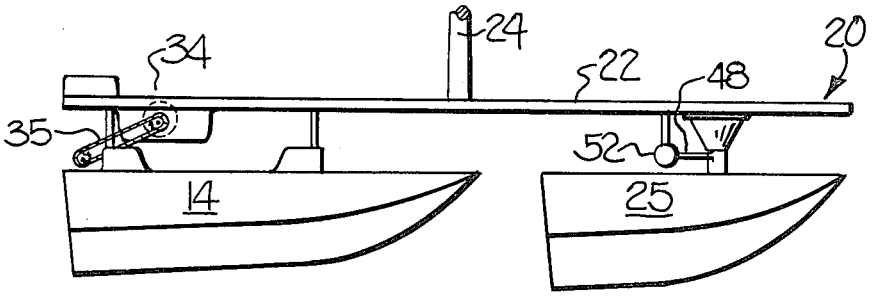
FIG. 2 is a side elevation view of the sailboat shown in FIG. 1.

Referring more specifically to the drawings, FIG. 1 illustrates a trimaran or three-hulled sailboat 10 which embodies the present invention. The sailboat 10 comprises a hull assembly 11 comprising first and second outrigger hulls 12 and 14, respectively, which are fixedly interconnected in a laterally spaced apart and laterally aligned relationship by means of a pair of parallel cross beams 15 and 16. The two hulls 12, 14 are fabricated, for example, from conventional fiberglass materials, and the beams 15, 16 are preferably fabricated from lightweight metal, such as aluminum. As illustrated, the beams are in the form of U-shaped channels in cross section, and alternatively, they may take the form of metal tubing.

Figure 4:
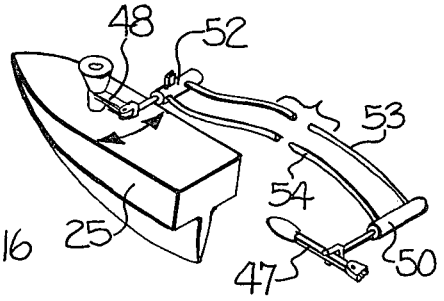
FIG. 4 is a fragmentary perspective view illustrating the steering mechanism for the forward hull of the craft.

A deck assembly 20 is mounted to the two beams 15, 16 of the hull assembly so as to permit relative lateral movement therebetween, and as indicated by the dashed lines in FIG. 1. More particularly, the deck assembly 20 comprises a generally flat deck 22 formed of fiberglass, wood or the like, and having a cockpit 23 formed therein at the stern for supporting the crew. Also, a mast 24 is fixedly mounted to the deck 22 for supporting a conventional sail (not shown), and all of the conventional standing and running rigging (not shown) for the mast and sail is secured to the deck assembly so that upon lateral movement as hereinafter further described, the entire deck assembly 20, including the mast, sails, and all rigging, will be moved. The deck assembly 20 further includes a third hull 25 mounted to the underside of the deck adjacent the bow or forward portion thereof. Also, as best seen in FIG. 4, the third hull 25 is mounted to the deck for rotation about a vertical axis.

Figure 3:
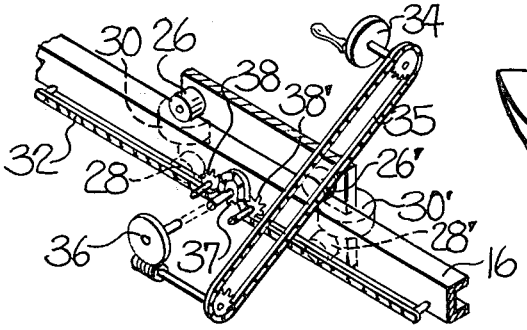
FIG. 3 is a fragmentary perspective view of the means for laterally moving the deck assembly between the two outer hulls.

The means for mounting the deck assembly 20 to the hull assembly 11 to permit relative lateral movement comprises a pair of roller assemblies mounted to the deck assembly. One of the roller assemblies is illustrated in FIG. 3, and comprises a pair of upper rollers 26, 26' for rotation about a horizontal axis and contacting the upper surface of the beam 16. A similar pair of lower rollers 28, 28' contact the lower surface of the beam, and a third pair of rollers 30, 30' are mounted to the deck assembly for rotation about a vertical axis and contact a side face of the beam. As seen in FIG. 1, the pairs of vertical rollers 30, 30' of the two roller assemblies respectively contact opposing sides of the two beams 15, 16, to preclude longitudinal movement between the deck assembly and hull assembly.

Means are also provided for selectively moving the deck assembly 20 laterally between the hulls 12, 14 and for maintaining a selected relative position therebetween. This moving means is best illustrated in FIG. 3, and comprises an elongate power transmission means or chain 32 which is fixed to and extends laterally along the beam 16. Manually operable sprocket means is fixed to the deck assembly, and comprises a hand wheel 34 mounted in the cockpit 23, a chain and sprocket assembly 35, a self-locking worm gear reducer 36, and a sprocket 37 which operatively engages the chain 32. A pair of idler sprockets 38, 38' are mounted to the beam 16 immediately adjacent the sprocket 37 to maintain proper engagement between the sprocket 37 and chain 32. As will be apparent from the above description, rotation of the hand wheel 34 by a crew member results in the deck assembly moving laterally along the beams 15, 16. Also, the worm gear reducer 36 acts to maintain a selected relative position by precluding rotational movement from the sprocket 37 toward the hand wheel 34. Thus lateral movement of the deck assembly can be effected only by the rotation of the hand wheel, and a crew member may rotate the hand wheel in either direction to move the deck assembly in the intended direction, and he may release his hold on the hand wheel and the deck assembly will maintain its relative position with respect to the hull assembly.

As best seen in FIG. 1, the means mounting the deck assembly 20 to the hull assembly 11 also includes a pair of cables 40, 41 which serve to limit and control canting or twisting movement between the deck assembly and hull assembly. The ends of each cable are fixed to the opposite hulls 12, 14 at longitudinally spaced points, and each end of each cable is laterally aligned with an end of the other cable. Two pairs of pulleys 42, 42' and 44, 44' are mounted to the underside of the deck portion, with one pair engaging each cable and so that each cable includes a medial portion which extends in a direction which has a substantial longitudinal component. Thus the two cables 40, 41 form a rigidifying somewhat X-shaped brace between the deck assembly and hull assembly, while permitting relative lateral movement therebetween. The pulleys are preferably mounted as close to the longitudinal centerline of the deck as possible so as to avoid contact between the pulleys and hulls during maximum lateral movement of the deck, and the adjacent pulleys may if desired be mounted for rotation about a common axis.

The illustrated sailboat further includes means for effecting steering of the craft by rotating the forward hull 25 about its vertical axis. This steering means is best illustrated in FIG. 4, and includes a tiller 47 which is pivotally mounted in the cockpit of the deck, a lever arm 48 fixed to the hull for rotation therewith about the vertical axis, and a hydraulic servo mechanism operatively interconnecting the tiller and lever arm. The servo mechanism comprises a first hydraulic cylinder 50 connected to the tiller and mounted to the deck, a second hydraulic cylinder 52 connected to the lever arm 48 and mounted adjacent the bow portion of the deck, and a pair of flexible hydraulic lines 53, 54 interconnecting the two cylinders. As will be apparent, lateral movement of the tiller 47 causes a corresponding pivoting movement of the lever arm 48, which in turn acts to rotate the hull 25 about its vertical axis.

Viewing FIG. 1, it will be seen that in the illustrated embodiment, the two outrigger hulls 12, 14 have a longitudinal length equal to about one-half that of the deck, and the third or forward hull 25 is only slightly less than one-half the length of the deck. Also, the three hulls are disposed in a triangular arrangement, and are adapted to concurrently support the weight of the craft in the water. This triangular arrangement is maintained upon lateral movement of the deck, and is seen to result in substantial stability for the craft. In this regard, planing type hulls are generally preferred with the present invention as opposed to displacement type hulls, since planing hulls have less draft, and provide less resistance to forward movement through the water. Since planing hulls tend to rise in the water as the forward speed increases, the longitudinal length of the hull which is in supporting contact with the water is reduced. This in turn reduces the longitudinal stability in the case of a single hull craft, and can result in "porpoising" or nosing over. The use of the triangularly arranged hulls of the present invention tends to alleviate this tendency, since while each planing hull will tend to lift in the water with speed, the longitudinal distance between the forward and two aft points of support would remain substantially constant at all speeds, thereby providing improved longitudinal stability.

While the specific embodiment of the invention as described herein relates to a sailboat, it will be understood that the novel features of the present invention are equally applicable to an iceboat having three triangularly arranged supporting members or runners, as well as a land sailing craft having three triangularly arranged wheels.

In the drawings and specification, there has been set forth a preferred embodiment of the invention, and although specific terms are employed, they are used in a generic and descriptive sense only and not for purposes of limitation.

That which is claimed is:

1. A multi-hulled sailboat characterized by the ability to limit heeling under various headings to thereby maximize the effective sail area and speed, and comprising a hull assembly comprising first and second hulls, and means fixedly interconnecting said hulls in a laterally spaced apart and laterally aligned relationship and including at least one laterally directed beam, a deck assembly comprising a deck adapted to support the crew of the sailboat, a mast fixed to said deck for supporting a sail, and a third hull mounted to said deck, means mounting said deck assembly to said hull assembly to permit relative lateral movement therebetween, and so that said three hulls are disposed in a triangular arrangement and are adapted to concurrently support the weight of the sailboat, said mounting means including cable means for limiting canting between said deck assembly and said hull assembly and comprising first and second cables fixedly interconnected between said first and second hulls, with the ends of each cable being fixed to opposite hulls at longitudinally spaced points, and pulley means mounted on said deck assembly and operatively engaging each cable so that each cable includes a medial portion which extends in a direction having a substantial longitudinal component, and means for effecting relative lateral movement between said deck assembly and said first and second hulls and for maintaining a selected relative position therebetween, whereby the weight of the deck assembly and crew may be moved toward the windward one of said first and second hulls to minimize heeling of the sailboat.

2. The sailboat as defined in claim 1 wherein said means for effecting relative lateral movement between said deck assembly first and second hulls comprises an elongate, laterally directed power transmission means fixedly mounted to said hull assembly, and manually operable sprocket means mounted to said deck assembly and operatively engaging said power transmission means, whereby operation of said sprocket means by the crew causes the deck assembly to move laterally with respect to said first and second hulls.

3. The sailboat as defined in claim 2 wherein said sprocket means includes hand rotation means mounted for manual rotation by the crew, a sprocket engaging said power transmission means, and self-locking gear reduction means operatively interconnecting said hand rotation means and said sprocket.

4. The sailboat as defined in claim 3 wherein said power transmission means comprises a chain.

5. The sailboat as defined in claim 1 wherein said means fixedly interconnecting said hulls comprises a pair of longitudinally spaced apart, laterally directed beams, and said mounting means comprises roller means mounted to said deck assembly and operatively contacting each of said beams to permit rolling movement therebetween.

6. The sailboat as defined in claim 1 wherein said third hull is mounted to said deck for rotation about a vertical axis, and wherein said sailboat further comprises means for steering the sailboat and including tiller means for rotating said third hull about its vertical axis.

7. The sailboat as defined in claim 6 wherein said tiller means comprises a tiller pivotally mounted to said deck, and hydraulic servo mechanism means operatively interconnecting said tiller and third hull.

8. The sailboat as defined in claim 1 wherein said third hull is mounted adjacent the bow portion of said deck, and said first and second hulls are mounted in alignment with the aft portion of said deck.

* * * * *